United States Patent [19]

Sansome et al.

[11] Patent Number: 4,655,065

[45] Date of Patent: Apr. 7, 1987

[54] PLUG DRAWING OF TUBES AND OTHER HOLLOW ITEMS

[75] Inventors: Dennis H. Sansome, Sutton Coldfield; Gerald M. Jones, Bewdley, both of England

[73] Assignee: National Research Development Corporation, London, England

[21] Appl. No.: 820,729

[22] Filed: Jan. 21, 1986

[30] Foreign Application Priority Data

Jan. 22, 1985 [GB] United Kingdom ..... 8501572

[51] Int. Cl.[4] ..... B21C 9/00; B21C 1/24

[52] U.S. Cl. ..... 72/45; 72/283

[58] Field of Search ..... 72/43, 44, 45, 97, 209, 72/367, 370, 283

[56] References Cited

U.S. PATENT DOCUMENTS

| | | | |
|---|---|---|---|
| 2,167,418 | 7/1939 | Findlater | 72/45 |
| 2,355,734 | 8/1944 | Katz | 72/45 |
| 2,363,476 | 11/1944 | Bannister | 72/97 X |
| 3,596,491 | 8/1971 | Cress et al. | 72/283 |

FOREIGN PATENT DOCUMENTS

| | | | |
|---|---|---|---|
| 2127177 | 10/1972 | France | 72/43 |
| 655930 | 8/1951 | United Kingdom . | |
| 625826 | 9/1978 | U.S.S.R. | 72/45 |
| 737035 | 5/1980 | U.S.S.R. | 72/209 |

*Primary Examiner*—E. Michael Combs

*Attorney, Agent, or Firm*—Cushman, Darby & Cushman

[57] ABSTRACT

A plug for use in the plug drawing of hollow tubes or other stock. A flexible and deformable seal is mounted on the rearward part of the plug. In its relaxed state this seal allows easy insertion of the plug into the stock before drawing begins. In its deformed state, which it is caused to adopt in use, it effectively seals the rearward end of a cylindrical clearance between the plug and the stock, so enabling this clearance to be filled with pressurized lubricant to improve drawing efficiency. The lubricant is supplied through passages formed in the plug and connected to a hollow conduit extending backwards within the undrawn stock. The conduit may be flexible, or may be rigid and then act as a plug bar. The plug may be in two parts which are caused, as drawing begins, to move relative to each other and in so doing to deform the seal.

5 Claims, 4 Drawing Figures

PLUG DRAWING OF TUBES AND OTHER HOLLOW ITEMS

Figure 1:
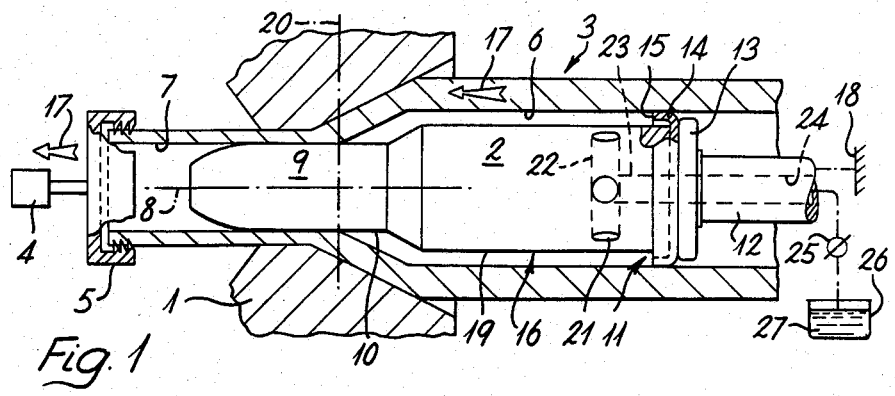

This invention relates to the plug drawing of tubes and other elongated stock of hollow section, and includes within its scope the known type of apparatus and process in which the plug is rigidly fixed on one end of a rod or bar, long enough to pass through the entire length of the undrawn stock so that the other end of the bar can be attached to fixed structure. It includes also the alternative known process and apparatus in which there is no such rigid support for the plug, which is relatively short in length and is so shaped that the reaction between it and the inner wall of the stock is sufficient to hold it in a stable manner within the drawing die as drawing proceeds, the final clearance between plug and die as usual defining the section of the drawn tube; such a plug is commonly known as a "floating" plug. In such alternative apparatus there may be no rod or bar at all, or if there is one it will be only movably-connected to the plug and will thus exert little if any substantial restraint upon it during use, the main purpose of such a bar being only to help insert the plug into the tube from the open end before drawing begins.

Plug drawing has been known and practised for a very long time, and the need has also long been appreciated for a copious supply of a suitable lubricant to be present at all times adjacent to the "nip" where the inner surface of the undrawn tube first converges upon and makes contact with the surface of the plug. Without such a supply of lubricant it is unlikely that a continuous, thin film of lubricant will be created and will persist between the plug and the tube over the cylindrical area of working contact beteween them that lies forward of the nip, and without such a continuous film the final inner surface of the drawn tube as it emerges from that region of contact may be imperfect, which can lead to imperfections in the outer surface also. Alternatively, such high friction forces may be generated that the tube will fracture.

Producing this lubricant film presents obvious problems however, bearing in mind the practical difficulties of lubricating the bore of the tube, and that at least at the start of a drawing operation the nip will be a long way from the trailing end of the undrawn tube, and accessible only through that end.

The present invention arises from appreciating the practicality of providing a seal to form an enclosed cylindrical space between the plug and the undrawn tube immediately upstream of the nip, and of supplying lubricant under pressure to this space from an external source by way of a duct formed within the body of the plug.

According to the invention a plug for use in the plug drawing of tube or other elongated stock of hollow section comprises a forward surface region, with which the inner wall of the stock makes contact as its radius diminishes in the course of drawing; a rearward region, adapted to lie with a clearance within the undrawn part of the stock at all times and separated from the forward region by an intermediate region; a flexible seal supported on the rearward region and capable of spanning the clearance, whereby to define a closed and substantially cylindrical space bounded at its forward end by the contact between plug and stock, at its rearward end by the seal, at its outer radius by the inner wall of stock and at its inner radius by the surface of the intermediate region; and a fluid passage formed through the body of the plug, having an outlet in the intermediate surface region and an inlet formed in the plug surface at a location to the side of the seal that is accessible from that part of the bore of the undrawn stock lying rearward of the plug.

There may also be a conduit located within the bore of the undrawn stock lying rearward of the plug and having an outlet connected to the passage inlet and an inlet connectable to a source of lubricant under pressure, whereby the enclosed space may be filled with such pressurised lubricant. The plug may be of "floating" type in which the conduit is either flexible or connected to the plug in a manner allowing relative movement between the parts so connected, or the conduit may be resistant to distortion and rigidly connected to the plug and thus adapted to act as a plug bar by which the plug is held axially steady in use.

The flexible seal may be of cup-like shape, the rim of the cup facing in the direction of drawing.

The plug may be in two parts capable of movement between two relative positions, the two parts both contributing to the support of the flexible seal, whereby in a first of those positions the seal is relatively collapsed but in the second position, adopted during use, the seal is expanded to block the clearance. The drag of the movement of the stock over the plug in use may cause the two plug parts to move into the second of their relative positions. The invention also includes methods of plug drawing a tube or other elongated stock of hollow section, using a plug as just defined, in which the clearance is filled with fluid at above ambient pressure, this fluid being supplied at least in part by way of the fluid passage through the body of the plug.

Figure 2:
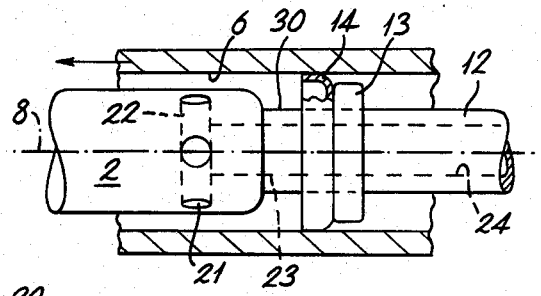
Figure 3:
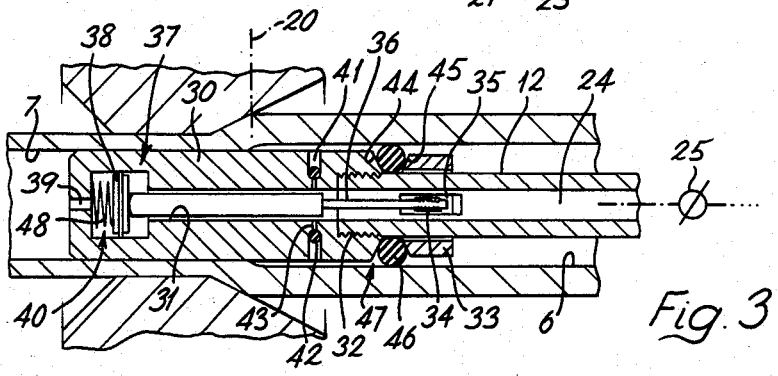
Figure 4:
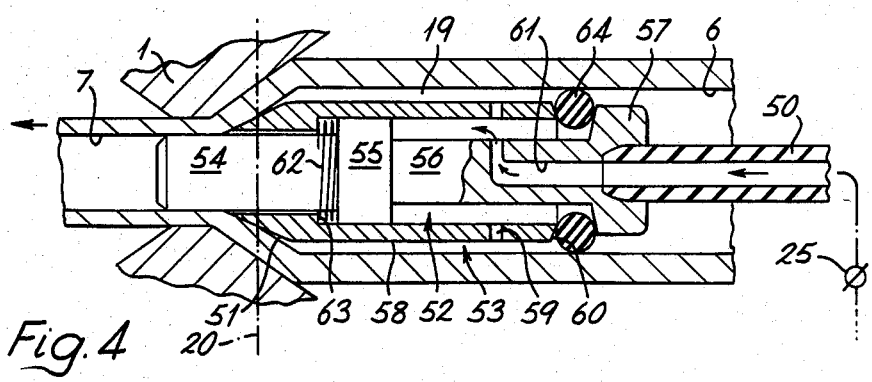

The invention will now be described, by way of example, with reference to the accompanying drawings in which:

FIGS. 1 to 3 are axial sections through three different bar-restrained plugs, and FIG. 4 is an axial section through a floating plug.

The Figures show a die 1, and a plug indicated generally at 2, between which a tube 3 is to be drawn by a drawing engine. Such an engine 4, attached to the forward end of the tube 3 by jaws 5, is shown in outline in FIG. 1 only. Reference 6 represents the bore of the undrawn tube, and reference 7 the bore of the drawn tube which is smaller in both inner and outer diameter. Reference 8 represents the drawing axis, and the plug 2 may be regarded as divided into forward, intermediate and rearward regions relative to that axis. In the forward region 9 the plug makes contact with the inner wall of the tube 3 as the latter diminishes in radius, and the diameter of the cylindrical surface 10 presented by this region of the plug determines the inner diameter of the drawn tube 7. At its opposite and rearward region 11 the plug 2 connects with a rigid plug bar 12, and washers are fixed in position: a rigid supporting washer 13 which fits with clearance within the bore 6, and a flexible and cup-shaped washer seal 14 arranged with its rim 15 pointing forwards and in contact with the bore. Between the forward and rearward regions 9 and 11, the surface of the intermediate region 16 of the plug is cylindrical and of a radius lying between those of the bores of the drawn and undrawn tubes 7 and 6. It will thus be apparent that in use, when engine 4 is drawing the tube 3 in the direction indicated by arrow 17 and when relative axial movement between die 1 and plug 2 is prevented by bar 12 which is anchored at 18, an enclosed and generally annular-section space 19 is formed. The radially-outer boundary of this space is presented by the bore of the undrawn tube 6, the radially-inner boundary by the surface of intermediate region 16 of the plug, the axially-forward end by the radial plane 20 where the tube first makes contact with the plug, and the axially-rearward end by the flexible seal 14. Ports 21 formed in the surface of region 16 communicate with conduits 22, 23 formed within the body of the plug, and thence by way of a bore 24 within the plug bar 12 to a pump 25 connected in turn to a reservoir 26 containing a suitable lubricant 27.

In use, while the orientation of the cup-shaped seal 14 ensures that the undrawn tube 6 can move freely over it in the direction of arrow 17, space 19 is filled with lubricant under pressure from reservoir 27 by way of pump 25 and conduits 24-22. The action of this lubricant upon the seal 14 is to tend to distend the cup and so increase the diameter of the rim 15 so that firm contact is promoted between the seal and the tube bore, preventing any substantial escape of lubricant from space 19 past the seal and so allowing a lubricant pressure substantially above ambient that is to say, above that existing in the tube bore immediately rearward of the plug - to be generated within the space 19 itself and thus to be present at the vital region of the radial plane 20 which marks the axially-rearward extremity of the zone of contact between the tube and the forward region 9 of the plug. At the start of a drawing operation enhanced pressure appears to have the particularly beneficial effect of tending to force lubricant into the interface between the tube and the plug, before the relative speed of tube and plug has reached a value where the motion alone might have the effect of forcing into that interface any film of lubricant carried by the bore of the undrawn tube. Thereafter, once a steady state drawing condition has been established, the value of the enhanced pressure within space 19 reflects not only the pressure delivered by pump 25, but also the hydrodynamic effect of the moving inner wall of tube 3 to carry lubricant with it into space 19 as it crosses over the seal 14. The enhanced lubricant pressure within space 19 then tends to maintain an unbroken thin film of lubricant over the entire area of contact between plug and tube, so minimising the drawing load that has to be exerted by engine 4 and lessening the risk of damage to the bore surface arising from a disrupted lubricant film.

The plug of FIG. 2 is more similar in shape to a conventional bar-supported plug in that it is reduced, at its most upstream end, to a shank 28, equal in outer diameter to the bar 12. The threaded engagement is now made between the bar and the shank, with the washer 13 and flexible seal 14 fixed in position where they meet.

Unlike the plugs of FIGS. 1 and 2, that of FIG. 3 is essentially in two parts, movable relative to each other in use so as to change the shape of the essential flexible seal. A hollow forward part 30, formed with an internal bore 31, is screw-threaded at 32 to receive the hollow plug bar 12, the remote end of which is connected as before to pump 25. The plug also comprises a ring-shaped rearward part 33, which makes a close but sliding fit over the bar 12 and is mounted on radial spokes 34 which pass through slots 35 formed in the wall of the bar. Within the bar the spokes 34 radiate from and are fixed to the reduced-section right-hand end of a rod 36 which lies with clearance within the bore 31. Towards its axially-forward end, this bore widens to form a cylinder 37 in which fits a piston 38 carried by the other, larger-section end of rod 36. A drilling 39 ensures that pressure in the part 40 of cylinder 37 to the axially-forward side of piston 38 is at the same pressure, typically ambient pressure, as exists within the bore of the drawn tube 7. A circumferential groove 41, containing a flexible "O"-ring 42, is formed around the outer surface of the forward part 30 of the plug and communicates, by way of drillings 43, with the bore 31. Forward and rearward parts 30 and 33 are separate and present confronting bevelled faces 44 and 45, and a flexible "O"-ring seal 46 is located in a groove 47 of which the faces 44, 45 form the sides, and the outer surface of bar 12 forms the base.

In operation, before the plug is inserted into the undrawn tube 6, a spring 48 acts on piston 38 so as to urge part 33 to the right (as viewed in FIG. 3), so widening the groove 47 and allowing the ring 46 to take up its shape of least radius. It therefore offers least interference and impediment when the plug is first inserted into the undrawn tube, the leading end of which will then in accordance with known practice be collapsed, fed through the die 1, gripped by the jaws 5 and pulled by the engine 4 until the plug lies within the die as shown and drawing may commence. If now pump 25 is energised to deliver lubricant at adequate pressure, the close sliding fit of part 33 over bar 12 minimises lubricant escape from the bore of the bar through the slots 35. Instead the lubricant acts in two main ways. First it acts on the axially-rearward face of piston 38 to move that piston to the left, compressing the light spring 48 and also moving plug part 33 to the left so as to shorten the groove 47 and thus expand the flexible ring seal 46 radially so that it makes a fit which makes an effective seal against both the inner wall of the undrawn tube 6 and the outer wall of bar 12, but still permits relative movement between the ring 46 and the inner wall of the tube. Secondly the pressure causes the "O"-ring 42 to yield so that lubricant under pressure passes by way of drillings 43 and groove 41 to enter the enclosed space 19, the axially-rearward end of which is now sealed by the expanded ring 46. As in previous Figures, therefore, the presence of lubricant under pressure is assured at the vital radial plane 20 where tube and die meet, and a continuous thin film of lubricant is promoted over the cylindrical interface between tube and plug immediately forward of that plane.

The floating plug of FIG. 4 is attached not to a plug bar, such as item 12, by which it would be restrained from forward movement in response to its reaction with the moving tube, but only to a non-rigid hollow tube 50 by which it is connected in use to the pump 25 as before. As is customary with fully floating plugs, this design embodies an inclined forward face 51 to bear against the tube wall as it converges just prior to the radial plane 20, so as to experience a reverse axial thrust which balances any forward thrust and therefore holds the plug axially steady. The plug is essentially in two parts, an inner part 52 and an outer part 53. The inner part 52 conventionally comprises a cylindrical nose 54 which defines the inner diameter of the drawn tube and which is preceded by a guiding boss 55 and shaft 56 ending in a shoulder 57. The inclined face 51 is at the axially-forward end of the outer part 53, and behind it lies a parallel-sided part 58 pierced by some drillings 59 and ending in an inclined rear face 60. Part 58 of the outer member forms the cylinder in which boss 55 moves, and high pressure lubricant enters that cylinder from flexible tube 50 by way of a passage 61 formed within shaft 56. A spring 62, which could be a Belleville washer for instance, is located between the boss 55 and a shoulder 63 presented by part 58. The flexible seal of this design is an "O"-ring 64 located between shoulder 57 and the inclined rear face 60 of outer part 53. In use, when the forward end of nose 54 is first gripped by the tube and drawing begins, inner part 52 will initially be drawn forward relative to outer part 53, so compressing the ring 64 axially but expanding it radially so that it firmly seals the axially-rearward end of enclosed space 19. This forward relative motion ceases when spring 62 becomes fully compressed between boss 55 and shoulder 63, the two parts 52 and 53 then being in the stable relative positon in which they remain while drawing proceeds. Lubricant under pressure emerging from passage 61 now enters the space 19 by way of the drillings 59, thus ensuring as before that the space 19 remains filled with lubricant at pressure at all times and that such pressurised lubricant is therefore always present at the radial plane 20 where tube and plug meet.

The operation of the floating plug of FIG. 4 would be similar if, instead of being connected to the flexible tube 50, it were attached to a rigid tube more like the bar 12 of previous Figures but by a sliding or other connexion permitting relative movement between plug and bar, so allowing the plug freedom to move forward as drawing proceeds and thus to take up its own position within the die 1. The invention includes such floating plugs.

We claim:

1. A method of plug-drawing an elongated tubular workpiece in a forward direction, comprising the following method steps:

providing such an elongated tubular workpiece presenting an inner wall and a transverse dimension;

forming a plug comprising a forward region with which said inner wall of said workpiece makes contact as its said transverse dimension diminishes in the course of drawing, a rearward region adapted to lie with a clearance within the undrawn part of said workpiece at all times, an intermediate region between said forward surface region and said rearward region;

providing a flexible and deformable ring seal and supporting said seal on said rearward region of said plug, said seal having a first and relaxed state in which it offers minimum resistance to relative movement of aid plug and said undrawn part of said workpiece and a second and deformed state in which it is adapted to make a firm contact with both said plug and said inner wall of said workpiece;

and providing through said plug a fluid passage having an outlet in said intermediate region and an inlet formed in said plug rearward of said seal so as to be accessible from that part of the interior of the said undrawn part of said workpiece lying rearward of said plug;

forming a cylindrical space bounded at the forward end thereof by the contact between said plug and said workpiece, at its inner radius by the surface of said intermediate region, at its outer radius by said inner wall of said workpiece and at its rearward end by said seal;

connecting said inlet to a source of lubricant under pressure, and so filling said cylindrical space with said lubricant; and drawing said workpiece over said plug, and in so doing exerting a forward force on at least part of said plug; and by the action of at least one of said above method steps, causing said seal to deform from its said first state to its said second state, whereby it seals said rearward end of said cylindrical space and so enhances the pressure at which said lubricant can be contained within said space without escaping from it by way of said rearward end.

2. A method of plug-drawing according to claim 1, in which the step of forming said plug includes forming it in first and second parts capable of relative movement in opposite senses, and of locating said seal relative to said parts so that said relative movement in one of said senses deforms said seal to its said second state while relative movement of said parts in the said opposite sense permits said seal to return to its said first and relaxed state, and in which said forward force on said plug resulting from the step of drawing said workpiece over said plug causes said first and second parts to execute relative motion in said first sense, so deforming said seal to its said second state.

3. A method of plug-drawing according to claim 1, in which the step of providing said flexible and deformable ring seal includes forming it in cup-like shape, the rim of said cup facing in said forward direction.

4. A method of plug-drawing according to claim 1, including in the said forming of said plug the feature that said plug is of floating type, and including also the step of providing a flexible conduit lying within the said undrawn part of said undrawn workpiece lying rearward of said plug, said flexible conduit having an outlet connected to said inlet of said fluid passage and an inlet connected to said source of lubricant under pressure.

5. A method of plug-drawing according to claim 1, including in the said forming of said plug the feature that said plug is of floating type and including also the step of providing a conduit lying within the said undrawn part of said workpiece lying rearward of said plug, said conduit having outlet connected to said inlet of said fluid passage and an inlet connected to said source of lubricant under pressure, and said conduit being rigid but attached to said plug in a manner which permits relative movement between said conduit and said plug so that said plug has freedom to move forward as drawing proceeds and thus to take up its own position within said workpiece.

* * * * *